US009177473B2

(12) United States Patent
Min et al.

(10) Patent No.: US 9,177,473 B2
(45) Date of Patent: Nov. 3, 2015

(54) VEHICLE ARRIVAL PREDICTION USING MULTIPLE DATA SOURCES INCLUDING PASSENGER BUS ARRIVAL PREDICTION

(75) Inventors: Wanli Min, Mount Kisco, NY (US); Laura Wynter, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 505 days.

(21) Appl. No.: 12/831,785

(22) Filed: Jul. 7, 2010

(65) Prior Publication Data

US 2012/0010803 A1 Jan. 12, 2012

(51) Int. Cl.
*G08G 1/123* (2006.01)

(52) U.S. Cl.
CPC ..... *G08G 1/123* (2013.01)

(58) Field of Classification Search
CPC ..... G08G 1/123; G08G 1/00; G08G 5/0008; G08G 1/14; G06G 7/70; G01S 19/42; G06Q 50/00; G06Q 10/00; G06F 9/44; G01C 21/36
USPC ..... 701/117, 118, 532, 5; 705/5; 703/20; 340/932.2; 244/3.1; 455/423
See application file for complete search history.

(56) References Cited

U.S. PATENT DOCUMENTS

2003/0148761 A1* 8/2003 Gaal ..... 455/423
2008/0035784 A1* 2/2008 Meserole et al. ..... 244/3.1
2008/0103751 A1* 5/2008 Hsiung et al. ..... 703/20
2008/0114707 A1* 5/2008 Steiner ..... 705/417
2008/0175161 A1 7/2008 Amemiya et al.
2010/0063715 A1* 3/2010 Wynter et al. ..... 701/118
2010/0235077 A1* 9/2010 Chan ..... 701/200
2010/0253542 A1* 10/2010 Seder et al. ..... 340/932.2
2011/0004496 A1* 1/2011 Erb ..... 705/5
2012/0010803 A1* 1/2012 Min et al. ..... 701/117
2012/0056758 A1* 3/2012 Kuhlman et al. ..... 340/932.2

OTHER PUBLICATIONS

Newell, C.J., et al., "Appendix A.2: Statistical Trend Analysis Methods," Feb., 2007, Air Force Center for Environmental Excellence, AFCEE Monitoring and Remediation Optimization System Software, Version 2.2, pp. A.2-1 to A.2-11.
Jain, A.K., et al., "Data Clustering: A Review," ACM Computing Surveys, Sep. 1999, vol. 31, No. 3.

(Continued)

*Primary Examiner* — Tuan C. To
*Assistant Examiner* — Yuri Kan
(74) *Attorney, Agent, or Firm* — Scully, Scott, Murphy & Presser, P.C.; Daniel P. Morris, Esq.

(57) ABSTRACT

A system, method and computer program product for estimating a vehicle arrival time. The system receives information representing prior travel times of vehicles between predetermined vehicle stops along a vehicle route. The system receives real-time data representing a current journey. The current journey refers to a movement of a vehicle currently traveling along the route. The system calculates a regular trend representing the current journey based on the received prior travel times information and the received real-time data. The system computes a deviation from the regular trend in the current journey. The system determines a future traffic status in subsequent vehicle stops in the current journey. The system estimates, for the vehicle, each arrival time of each subsequent vehicle stop based on the calculated regular trend, the computed deviation and the determined future traffic status.

26 Claims, 9 Drawing Sheets

(56) References Cited

OTHER PUBLICATIONS

Gerstman, B., "15: Regression," Mar. 2004, http://www.sjsu.edu/faculty/gerstman/StatPrimer/regression.pdf.
Murphy, K. P., "Linear regression," Mar. 13, 2007, pp. 1-34.
Feijen, W., et al., "The Binary Search Revisited," AvG127/WF214, 1995, http://www.mathmeth.com/wf/files/wf2xx/wf214.pdf.
Hahn, K., "Lagrange Multiplier Method for finding Optimums," 2008, http://www.karlscalculus.org/pdf/lagrange.pdf.
Alford, B., et al., "An Analysis of Various Spline Smoothing Techniques for Online Auctions Amsc 689," Dec. 2004.

* cited by examiner

600

| BUS SVC. NO. 61 | STOP.12.57 (640) | STOP.14.97 | STOP.19.47 (620) | STOP.20.64 | STOP.21.98 | STOP.22.41 | STOP.23.25 | STOP.23.75 |
|---|---|---|---|---|---|---|---|---|
| | | | | | | | | |
| M1: 10-STOP AHEAD | 2.865 | 2.592 | 3.778 | 2.825 | 2.952 | 2.202 | 2.303 | 2.703 |
| M1: 5-STOP AHEAD | 1.746 | 1.779 | 1.238 | 0.96 | 1.658 | 1.712 | 2.189 | 2.191 |
| | | | | | | | | |
| M2: 10-STOP AHEAD | 1.727 | 1.359 | 1.325 | 0.78 | 1.62 | 1.2 | 1.171 | 1.558 |
| M2: 5-STOP AHEAD | 1.451 | 1.037 | 0.634 | 0.727 | 1.263 | 0.898 | 0.802 | 0.981 |

610 650 640

| BUS SVC. NO. 75 | STOP.3.73 | STOP.4.64 (630) | STOP.5.73 | STOP.6.32 | STOP.7.17 | STOP.10.21 |
|---|---|---|---|---|---|---|
| | | | | | | |
| M1: 10-STOP AHEAD | 5.05 | 4.022 | 4.075 | 4.907 | 1.587 | 1.68 |
| M1: 5-STOP AHEAD | 2.484 | 2.862 | 2.426 | 2.108 | 1.22 | 1.565 |
| | | | | | | |
| M2: 10-STOP AHEAD | 2.072 | 1.71 | 1.735 | 1.372 | 0.59 | 1.387 |
| M2: 5-STOP AHEAD | 2.416 | 0.982 | 1.12 | 0.89 | 0.645 | 0.778 |

$$\log(A^{i,i+1}_{t}) = \log(\mu A^{i,i+1}_{t}) + \sum_{k=1}^{NO.\ of\ TPT\ Links} a_k[\log(V^{i+1}_{t+k}) - \log(\mu V^{i+1}_{t+k})]$$

1000 1050 1060 1030

$$\mu A^{i,i+1}_{t} = \partial A^{i,i+1}_{t} + \sum_{k=1}^{q} \lambda(A^{i,i+1}_{t-k} - \partial A^{i,i+1}_{t-k})$$

1010 1020 1040

$\partial A^{i,i+1}_{t}$ IS THE BENCHMARK, SUCH AS HISTORICAL MEAN

VEHICLE ARRIVAL PREDICTION USING MULTIPLE DATA SOURCES INCLUDING PASSENGER BUS ARRIVAL PREDICTION

BACKGROUND

The present application generally relates to determining a bus arrival time at each bus stop of a plurality of bus stops. More particularly, the present application relates to predicting a bus arrival time based on prior travel times between bus stops and real-time data representing a current journey.

Predicting arrivals of buses and/or other transportation vehicles at bus stops or designated locations is important in making a public transporting system more appealing and more efficient for passengers. With accurate bus arrival predictions communicated or presented to passengers, the passengers can make informed decisions about how to travel.

Improving a public transporting system is critical for reducing congestions on urban roadways. Providing timely accurate predictions about bus arrivals at bus stops along bus routes is one important step to improve public transporting system. Current systems for predicting arrival times of buses at bus stops rely on GPS (Global Positioning System) location information of the buses. While those current systems represent improvements over prior systems that have no available information of predicting bus arrival times, predictions of the current systems are not accurate, e.g., buses arrive more than 5 min later from the predictions. What occurs then is that the passengers, having perceived the predictions to be inaccurate, can no longer rely on the predictions at all. Thus, in many cities, such current systems have been abandoned for this reason, i.e., inaccuracies.

There may be several reasons why the current systems predict inaccurately bus arrival times: 1. The current systems use algorithms that may need further improvements; 2. Input data to the current system is not rich enough to permit an accurate estimation of bus arrival times. For example, the current systems use GPS information of bus positioning only to obtain data of bus travel time on segments that the bus already traversed. The GPS information does not provide information on traffic in an upcoming route.

SUMMARY OF THE INVENTION

The present disclosure describes a system, method and computer program product for predicting a bus arrival time at each bus stop of each bus line or route.

In one embodiment, there is provided a system for determining a vehicle arrival time. The system comprises a memory device and a processor being connected to the memory device. The system receives information representing prior travel times of vehicles between vehicle stops along a vehicle route. The system receives real-time data representing a current journey. The current journey refers to a movement of a vehicle currently traveling along the route. The system calculates a regular trend representing the current journey based on the received prior travel times information and the received real-time data. The system computes a deviation from the regular trend in the current journey. The system determines a future traffic status in subsequent vehicle stops in the current journey. The system estimates, for the vehicle, each arrival time of each subsequent vehicle stop based on the calculated regular trend, the computed deviation and the determined future traffic status.

In a further embodiment, to calculate the regular trend, the system performs a trend analysis or clustering on the received prior travel times information and the received real-time data.

In a further embodiment, to compute the deviation, the system performs a regression analysis on the received prior travel times information and the received real-time data.

In a further embodiment, to determine the future traffic status, the system obtains future traffic condition information of the subsequent vehicle stops from a traffic prediction tool. The future traffic condition information of the subsequent vehicle stops is integrated in the estimated arrival time.

BRIEF DESCRIPTION OF THE DRAWINGS

The accompanying drawings are included to provide a further understanding of the present invention, and are incorporated in and constitute a part of this specification.

DETAILED DESCRIPTION

As referred to herein, a "bus" refers to any transportation vehicle (e.g., a truck, a carrier, a subway car, etc.) that travels between designated stops along a designated route. In one embodiment, a computing system (e.g., a computing system 400 in FIG. 4) uses data (e.g., future traffic condition information) from a TPT (Traffic Prediction Tool), for example, the one which has been described in currently pending, commonly owned U.S. Patent Publication No. 2008/0175161 and U.S. Patent Publication No. 2010/0063715, the whole contents and disclosure of which are wholly incorporated by reference as if fully set forth herein. As well as the data location) with a novel algorithm (e.g., a flow chart in FIG. 1) to predict a bus arrival time at each bus stop at each bus line.

Figure 3:
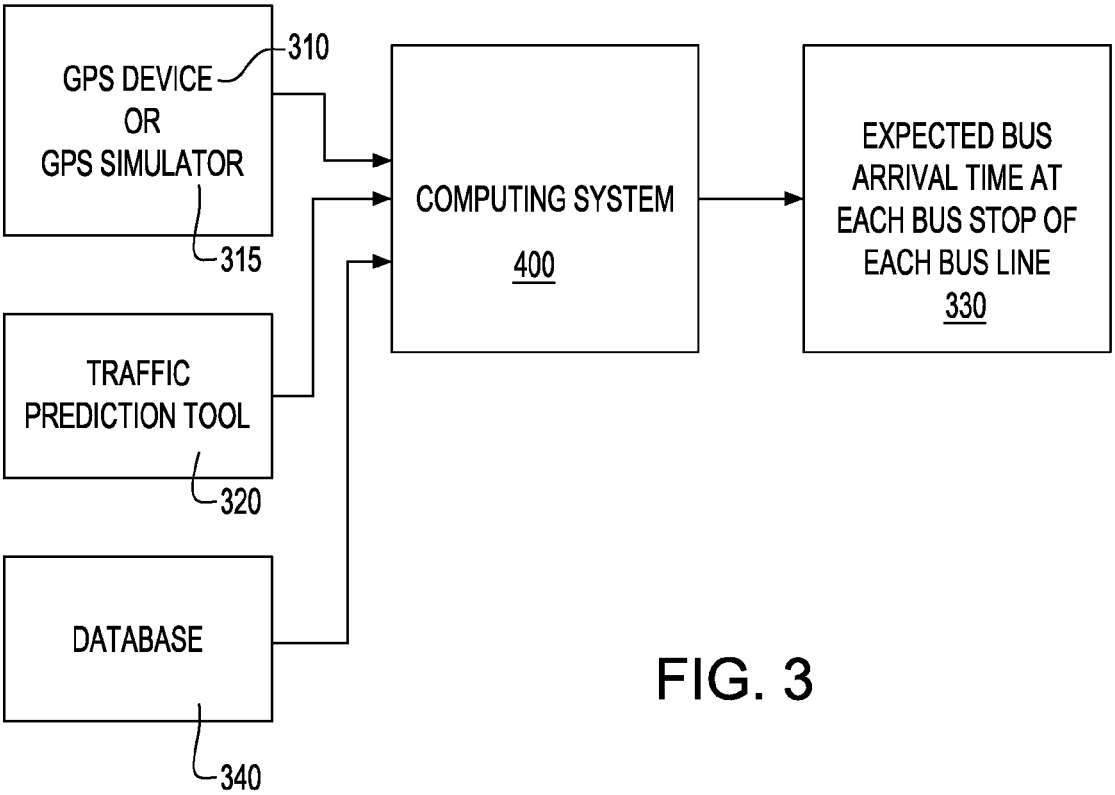
FIG. 3 is a system diagram illustrating components to predict a bus arrival time in one embodiment.

FIG. 3 is a system diagram illustrating components to predict a bus arrival time in one embodiment. In this embodiment, the computing system 400 receives real-time bus location information from a GPS device 310 or GPS simulator 315 attached on the bus. GPS device 310 includes, but is not limited to, Garmin® GPS systems, TomTom® GPS systems, Magellan® GPS systems, or other equivalent GPS systems that communicate with at least one GPS satellite to receive real-time bus location information from the satellite.

GPS simulator 315 is a device to emulate the GPS device 310 when the GPS device 310 is unavailable to send the real-time bus location information. Operations of the GPS simulator 315 are described in detail below in conjunction with FIG. 2. TPT 320 provides future traffic status information on each road line to the computing system as described in the above-mentioned U.S. Patent Publication No. 2008/0175161 and U.S. Patent Publication No. 2010/0063715. Database 340 (e.g., IBM® DB2®, Oracle®, etc.) provides prior GPS data and individual transaction data to the computing system 400. In a further embodiment, the prior GPS data record bus arrival and departure times associated with each bus stop. The transaction data provide tapping record (e.g., a record indicating when a passenger boards a bus or leaves a bus, etc.) at each bus stop.

Figure 1:
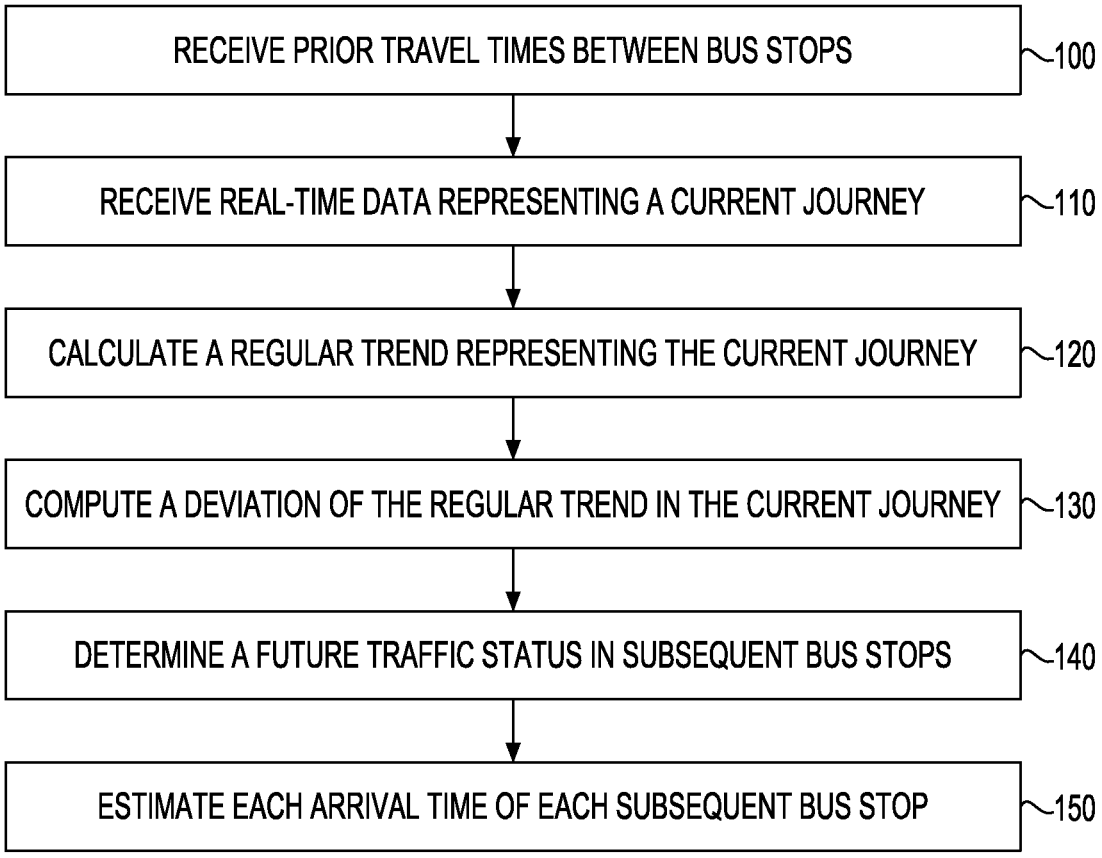
FIG. 1 is a flow chart illustrating method steps for determining a bus arrival time according to one embodiment.

The computing system 400 operates according to method steps described in FIG. 1. At steps 100-110 in FIG. 1, upon receiving information representing prior travel times of buses between bus stops, e.g., from the database 340, and receiving real-time data (e.g., real-time bus location data) representing a current journey of a bus from the GPS device 310 or GPS simulator 315, the computing system 400 analyzes, in real-time or in off-line, the received prior travel times information and the real-time data. The current journey refers to a current movement of the bus, e.g., a driving direction of the bus, a current location of the bus, etc. Specifically, at step 120 in FIG. 1, the computing system 400 calculates a regular trend (e.g., a historical average speed) that represents the current journey, e.g., by performing a trend analysis and/or clustering speed) that represents the current journey, e.g., by performing a trend analysis and/or clustering on the received prior travel time information and/or the received real-time data. Trend analysis refers to collecting data and finding a pattern or model or trend in the data. Trend analysis is described in detail in Newell, C. J., et al., "Appendix A.2: Statistical Trend Analysis Methods," February, 2007, Air Force Center for Environmental Excellence, the whole contents and disclosure of which are wholly incorporated by reference as if fully set forth herein. Clustering refers to herein grouping elements into subsets (clusters) so that elements in a subset have similar properties or characteristics. Clustering technique described in detail, A. K. Jain, et al., "Data Clustering: A Review," ACM Computing Surveys, Vol. 31, No. 3, September 1999, the whole contents and disclosure of which are wholly incorporated by reference as if fully set forth herein.

Figure 7A:
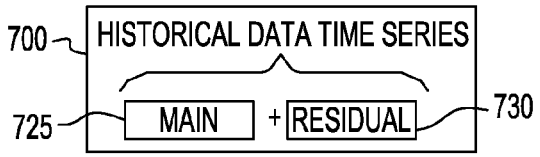
FIG. 7A illustrates dividing prior travel times information into two groups in one embodiment.
Figure 7B:
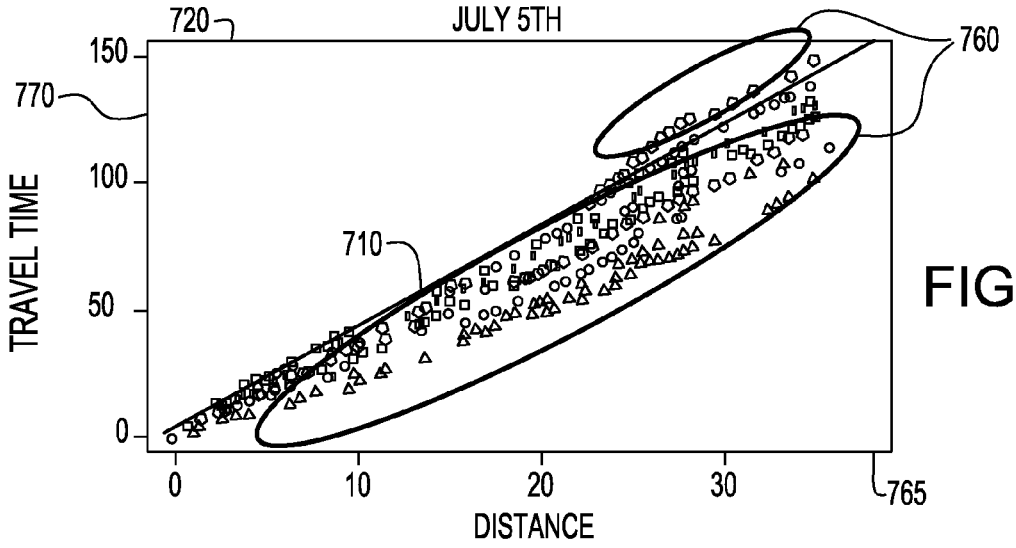
FIG. 7B illustrates a relationship between a bus travel time and a distance from a point of an origin or departure for several journeys of one day in one embodiment.
Figure 7C:
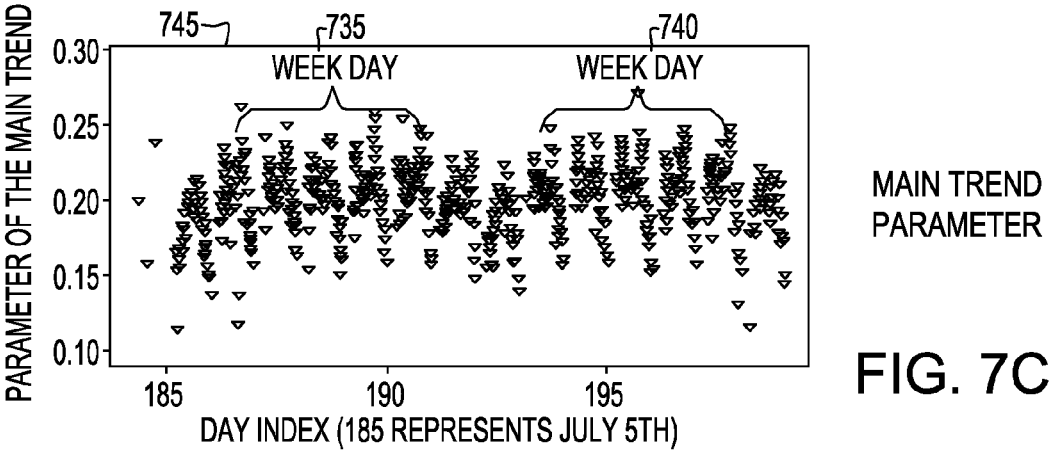
FIG. 7C illustrates an exemplary regular trend showing similar patterns in one embodiment.
Figure 7D:
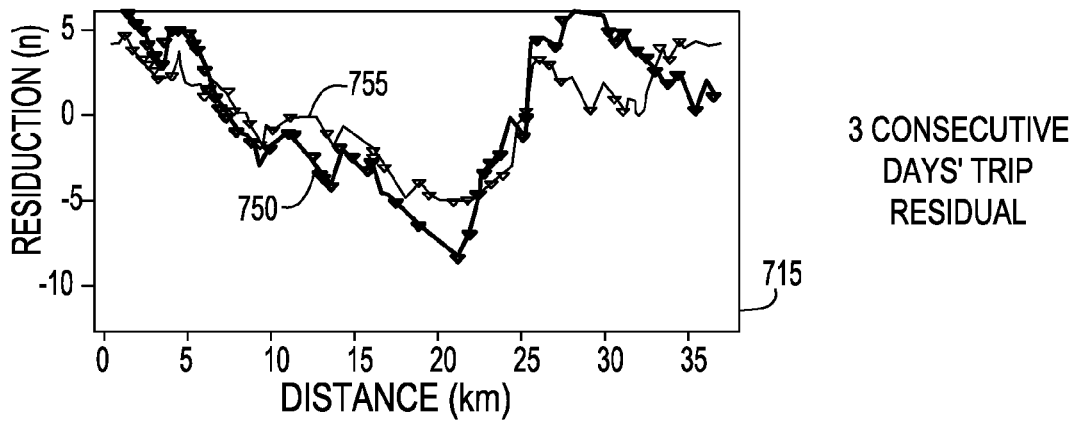
FIG. 7D illustrates exemplary residuals in one embodiment.

As shown in a box 700 in FIG. 7A, the computing system divides the received prior travel times information, for example, into two parts: the regular (main) trend 725 (e.g., a graph 745 in FIG. 7C) and deviations 730 (e.g., residuals shown in a graph 715 in FIG. 7D), e.g., by performing regression and trend analysis on the prior travel times. FIG. 7B is a graph 720 that shows a relationship between a bus travel time and a distance from a point of an origin or departure for several journeys of one day. The graph 720 shows a linear relationship (e.g., a slope 710) between the travel time and the distance that suggests each journey has a stable speed that is represented by the slope 710. FIG. 7C is a graph 745 representing the calculated regular trend 725 that shows seasonal patterns (e.g., a weekday pattern 735 and another weekday pattern 740). FIG. 7D is a graph 715 illustrating two exemplary residuals 750-755 (i.e., deviations from the regular trend) that also show similar pattern for same departure times of consecutive days.

Figure 8A:
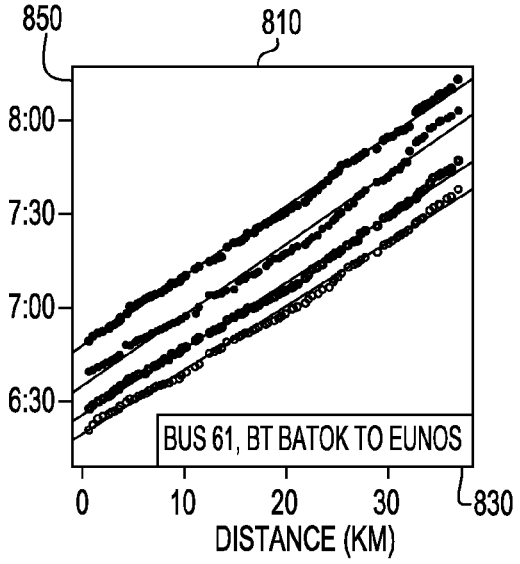
FIGS. 8A-8B illustrate exemplary graphs that show similarity among consecutive bus trips in one embodiment.
Figure 8B:
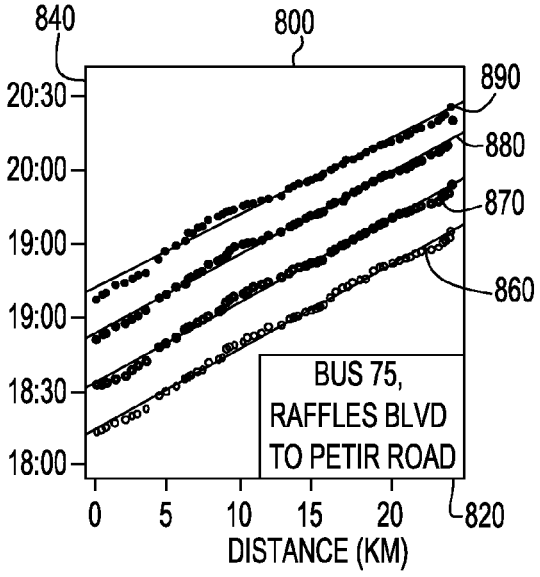

FIGS. 8A-8B illustrate exemplary clustering techniques applied on journeys performed during similar time frames on different days for two exemplary bus routes. Two graphs 800 and 810 in FIG. 8 shows similarity, among consecutive journeys for the two exemplary bus routes, found by applying the clustering techniques on the consecutive journeys. For example, the graph 800 shows the first journey 860, the second journey 870, the third journey 880 and the fourth journey 890 have similar average speed, e.g., similar slopes. In these graphs 800-810, X-axis (e.g., X-axis 820-830) represents a distance. Y-axis (e.g., Y-axis 840-850) represents times.

Figure 11:
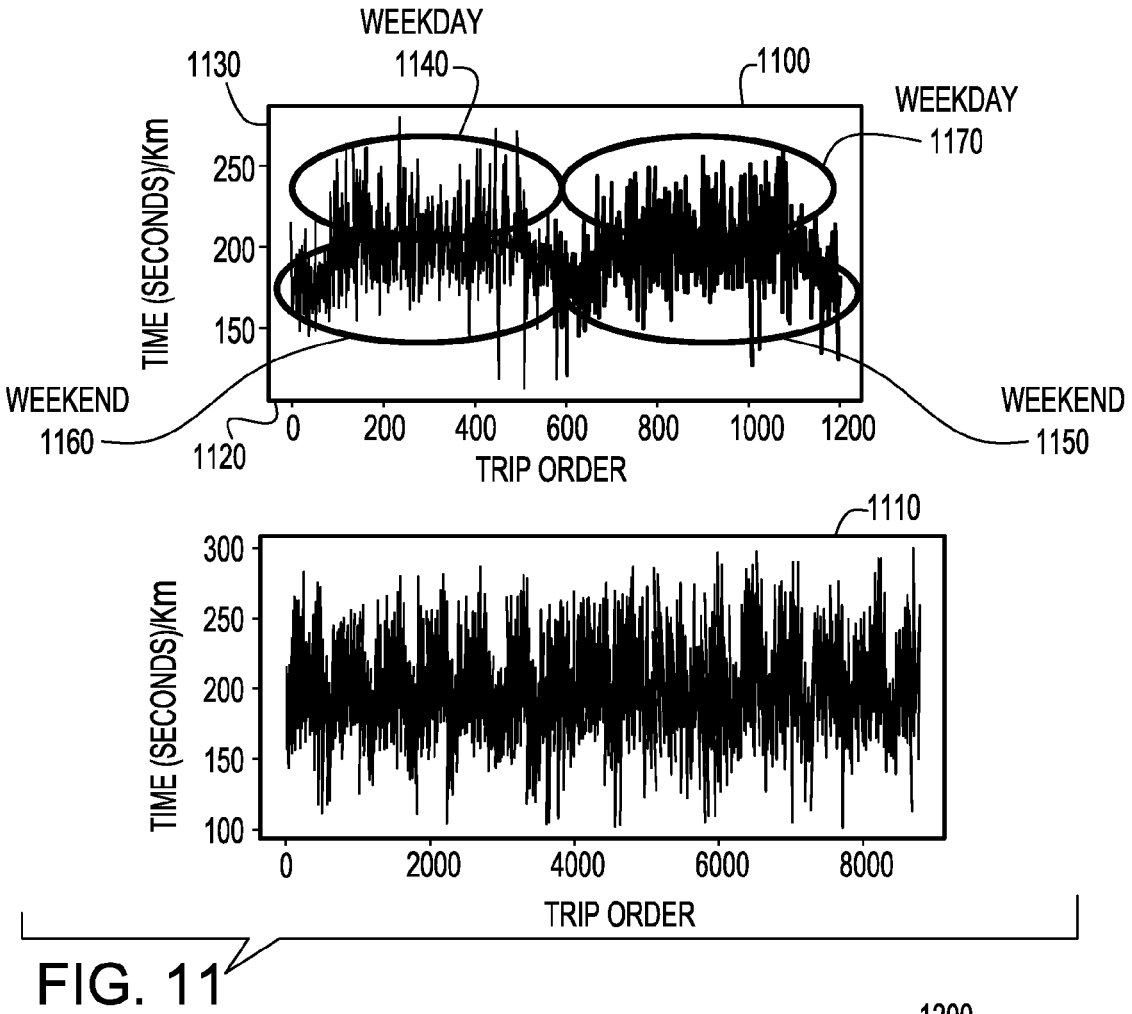
FIG. 11 illustrates an exemplary trend of each bus trip in one embodiment.

FIG. 11 also illustrates an exemplary clustering technique applied on an exemplary bus route over 2 weeks (graph 1100) and over 14 weeks (graph 1110). Graphs 1100-1110 show seasonal patterns/trends. For example, the graph 1100 shows a similar trend between two weekdays: weekday 1140 and weekday 1170. The graph 1100 also shows a similar trend between two weekends: a weekend 1150 and a weekend 1160. X-axis (e.g., X-axis 1120) on the graphs 1100-1110 represents an order of a journey. Y-axis (e.g., Y-axis 1130) on the graphs 1100-1110 represents time (e.g., seconds)/distance (e.g., Km).

Returning to FIG. 1, at step 130, the computing system 400 computes a deviation from the regular trend in the current journey, e.g., by performing a regression analysis on the received prior travel times and the received real-time data. Regression analysis refers to modeling and analyzing relationships between dependent variables and independent variables. Regression analysis is described in detail in Bud Gerstman, "15: Regression," March, 2004, http://www.sjsu.edu/faculty/gerstman/StatPrimer/regression.pdf, wholly incorporated by reference as if set forth herein. The computing system 400 may construct a deviation model (e.g., graph 715 in FIG. 7) to account for the deviation from the regular trend, e.g., by performing a trend analysis, linear regression and/or other equivalent analysis. Kevin P. Murphy, "Linear regression," Mar. 13, 2007, wholly incorporated by reference as if set forth herein, describes linear regression technique in detail.

Returning to FIG. 1, at step 140, the computing system 400 determines a future traffic status in subsequent bus stops. To determine the future traffic status, the computing system receives future traffic condition information of the subsequent bus stops from the TPT 320. The received future traffic condition information includes, but is not limited to: the future traffic status in the subsequent bus stops, traffic quantity prediction information every certain time frame, traffic quantity prediction on each lane on which the TPT 320 is installed.

At step 150 in FIG. 1, the computing system 400 estimates each bus arrival time at each subsequent bus stop based on the calculated regular trend, the computed deviation and the determined future traffic status, e.g., by solving formula (7) and/or (8) described below. The formula (7) and/or (8) integrates the future traffic condition information of the subsequent bus stops into the estimated arrival time 330. The computing system 400 outputs the estimated arrival time 330 as shown in FIG. 3.

Figure 9:
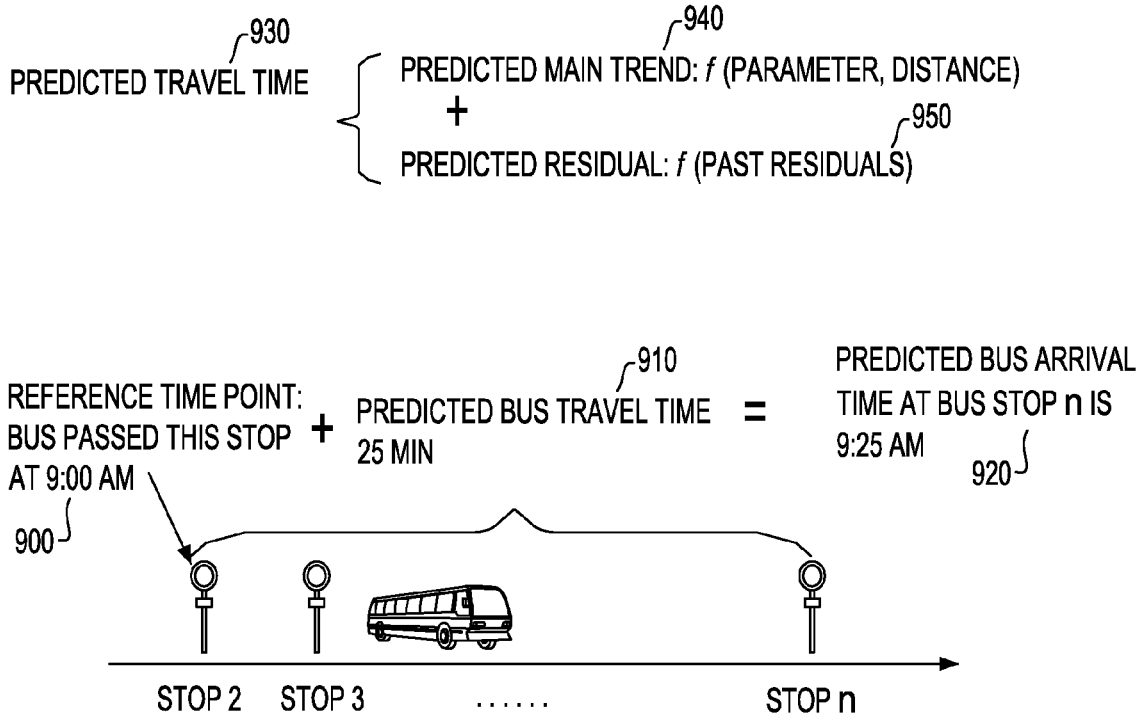
FIG. 9 illustrates an example of predicting a bus arrival time in one embodiment.

Alternatively, the computing system 400 estimates each bus arrival time at each subsequent bus stop along a bus route based on the calculated regular trend, the computed deviation, and the real-time GPS data of bus locations without using the future traffic status. FIG. 9 illustrates an example to estimate a bus arrival time at a subsequent bus stop based on the calculated regular trend, the computed deviation, and the real-time GPS data of bus locations without using the future traffic status. In this example shown in FIG. 9, the computing system receives the real-time GPS data 900 that indicates that a bus passes stop 2 at a referent time point (e.g., 9:00 AM). The computing system 400 estimates bus travel time 910, e.g., by computing: the estimated bus arrival time 910=the calculated regular trend 940 (e.g., a historical average speed)×an expected distance between the stop 2 and stop n (assumed to be given; not shown)+/−the computed deviation 950. The computing system 400 estimates a bus arrival time 920, e.g., by adding the reference time point (e.g., 9:00 AM) and the estimated bus travel time 910 (e.g., 25 min). The calculated regular trend 940 is a function of a parameter (e.g., time duration) and a distance as shown in FIGS. 8A-8B. The computed deviation 950 is a function of prior residuals as shown in FIG. 7D.

In a further embodiment, to perform the analysis (method steps 120-150 in FIG. 1) in off-line, the computing system retrieves historical GPS data of bus locations from the database 340. To perform the analysis in real-time, the computing system 400 receives the real-time GPS data of bus locations continuously from the GPS device 310 or GPS simulator 315. For example, the computing system receives the GPS data of bus locations at least once per minute or more frequently. The real-time GPS data may have stable latency (e.g., at most 2 minutes delay) in transmission. In a further embodiment, the database 350 stores historical GPS data of bus locations for a pre-determined time interval, e.g., at least recent past two months. The database 320 may regularly update the historical GPS data of bus locations to re-compute the off-line analysis. The re-computation may require historical GPS data, for example, from approximately the most recent two months. The historical GPS data of bus locations includes, but is not limited to, prior travel times between bus stops, prior bus arrival times at bus stops, etc.

The computing system 400 matches the real-time and/or historical GPS data to a corresponding bus route and converts the real-time and/or historical GPS data to a distance with respect to an immediate next bus stop. In addition to a scheduled report of the real-time GPS data of a bus location, e.g., by every one minute interval, the GPS device 310 may send additional reports of the real-time GPS data of a bus location whenever the bus enters and/or leave a bus stop.

In a further embodiment, in addition to the historical GPS data, the computing system 400 retrieves transaction data for a pre-determined time interval (e.g., transaction data for at least recent two months), e.g., from the database 340. The database 340 may regularly update the transaction data to assist re-computing the analysis off-line and/or in real-time. The computing system 400 deduces historical bus arrival times at a bus stop from the transaction data. For example, a smartcard transaction data (e.g., banking card transaction history) that reflects when a particular passenger paid a bus fee to board a particular bus at a particular location reflects an arrival time of the particular bus at the particular location. Data captured in a smartcard includes, but is not limited to: smartcard ID (Identification), transaction date and time, bus stop ID, bus route number, bus route direction, etc.

The TPT 320 provides the future traffic condition information to the computing system 400. As the TPT 320 provides the future traffic condition information more stably or steadily, the computing system 400 improves more accuracy of the estimated arrival time at each bus stop.

Figure 4:
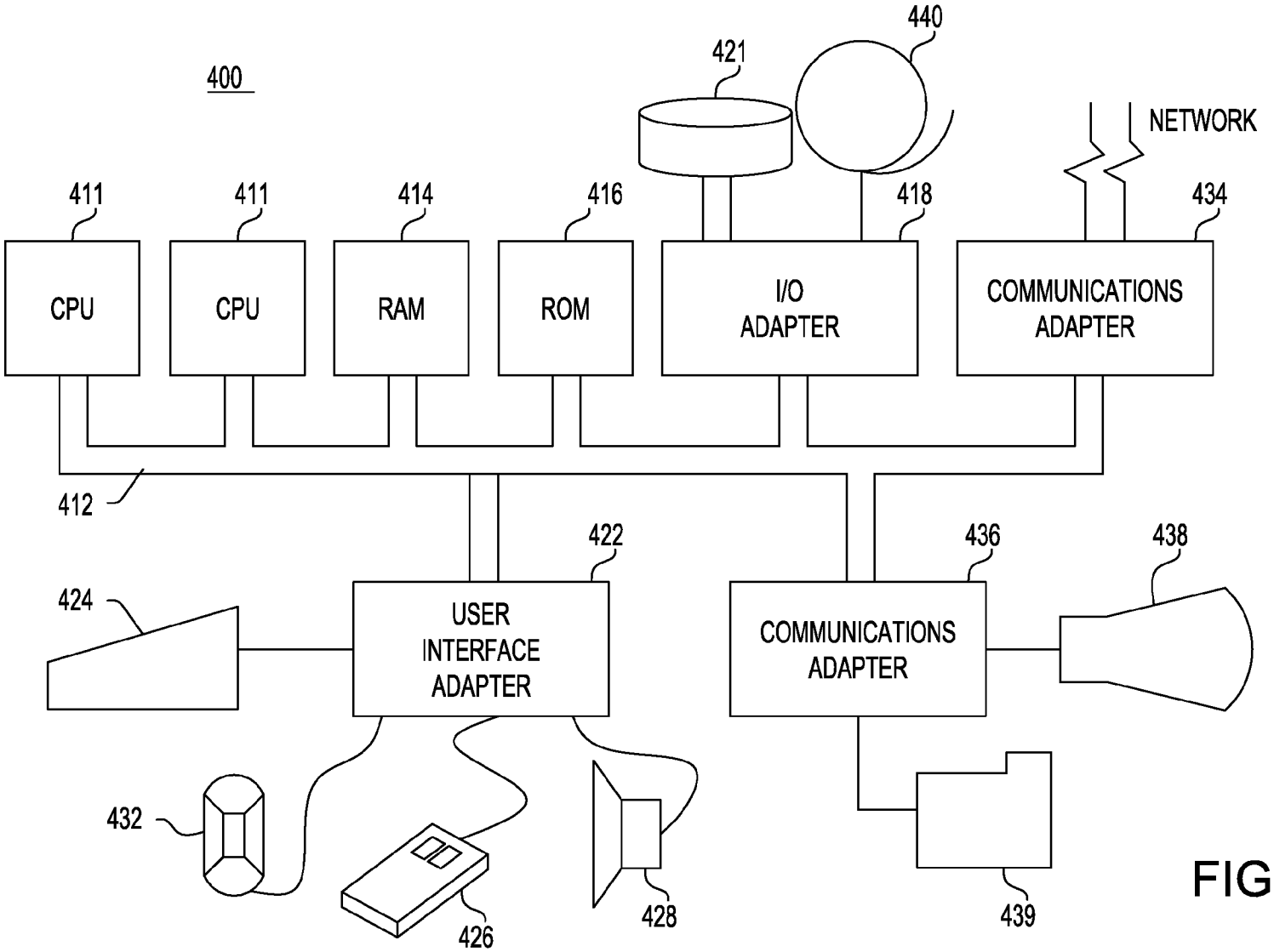
FIG. 4 illustrates an exemplary hardware configuration to implement a computing system in one embodiment.

FIG. 4 illustrates an exemplary hardware configuration of the computing system 400. The hardware configuration preferably has at least one processor or central processing unit (CPU) 411. The CPUs 411 are interconnected via a system bus 412 to a random access memory (RAM) 414, read-only memory (ROM) 416, input/output (I/O) adapter 418 (for connecting peripheral devices such as disk units 421 and tape drives 440 to the bus 412), user interface adapter 422 (for connecting a keyboard 424, mouse 426, speaker 428, microphone 432, and/or other user interface device to the bus 412), a communication adapter 434 for connecting the system 400 to a data processing network, the Internet, an Intranet, a local area network (LAN), etc., and a display adapter 436 for connecting the bus 412 to a display device 438 and/or printer 439 (e.g., a digital printer of the like).

The GPS simulator 315 receives historical bus arrival times and/or prior bus travel times from the database 340, and emulates actual GPS data of bus locations, e.g., with one minute time interval or other time interval.

Figure 12:
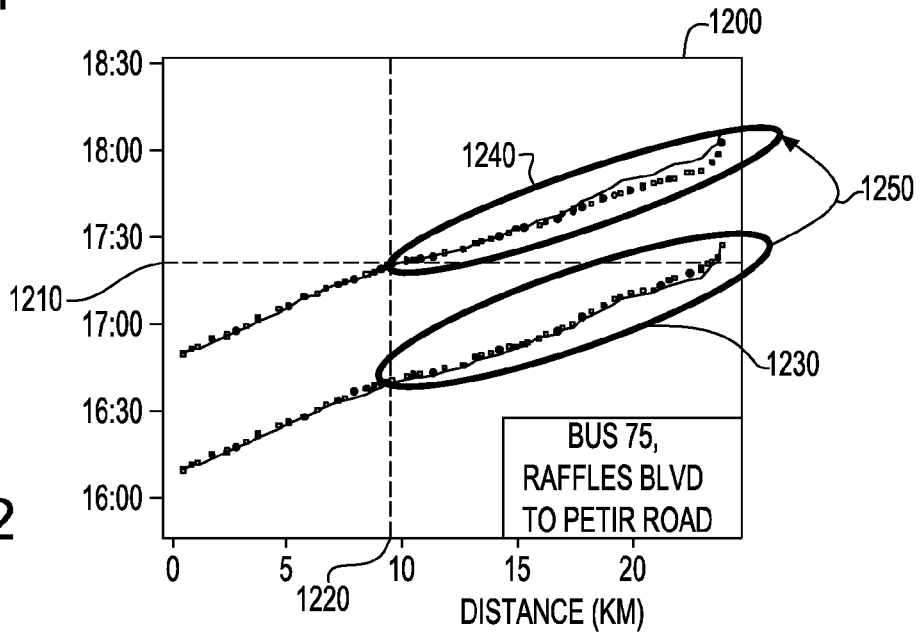
FIG. 12 illustrates an exemplary bus location simulation generated by a GPS simulator in one embodiment.

FIG. 12 illustrates exemplary emulated GPS data. In this example shown in FIG. 12, at 17:26 (1210) whose location corresponds to 9.55 Km (1220) from a departure, the computing system 400 does not receive real-time GPS data from the GPS device 310. Then, the computing system 400 fits 1250 a lower curve 1230 (e.g., the regular trend calculated based on the historical bus arrival times and/or prior bus travel times) into an upper curve 1240 where the real-time GPS data is missing from the location 1220 and the time 1210. Operations of the GPS simulator 315 are described in detail in conjunction with FIG. 2.

For a case when real-time GPS data of bus location may not arrive at the computing system 400 according to an anticipated reporting time schedule, e.g., once per minute, in a real-time data stream, the computing system 400 may need the GPS simulator 315 to estimate the missing real-time GPS data of bus locations. To emulate the real-time GPS data of bus locations, the GPS simulator 315 may need a distance (e.g., a distance 1220 in FIG. 12), from a departure stop, at which the real-time GPS data is not available. Alternatively, the GPS simulator 315 may need global coordinates of a location from which the real-time GPS data is not available. For example, the GPS simulator 315 may match that location to a pre-loaded map to find the global coordinate of that location.

The GPS simulator 315 ensures stable real-time GPS data input to the computing system 400 and reduces an occurrence of missing output (e.g., the estimated bus arrival time 330) due to possible missing real-time GPS data. In one embodiment, the GPS simulator 315 simulates a would-be location (a distance toward a target bus stop) of bus upon receiving the historical GPS data of bus arrival times to bus stops from the database 340. More specifically, in this embodiment, the GPS simulator 315 assumes a bus travels between two consecutive stops with three stages: accelerate, cruise, and decelerate. The GPS simulator 315 estimates a speed vs. time curve (not shown) in order to match a travel time and a distance between the two consecutive stops. From the speed vs. time curve, the GPS simulator 315 infers whereabouts of this bus according to the anticipated reporting time schedule (e.g., once per minute). In another embodiment, the GPS simulator 315 runs method steps described in FIG. 2 to emulate the real-time GPS data of bus locations. These method steps in FIG. 2 are described in detail below.

Figure 2:
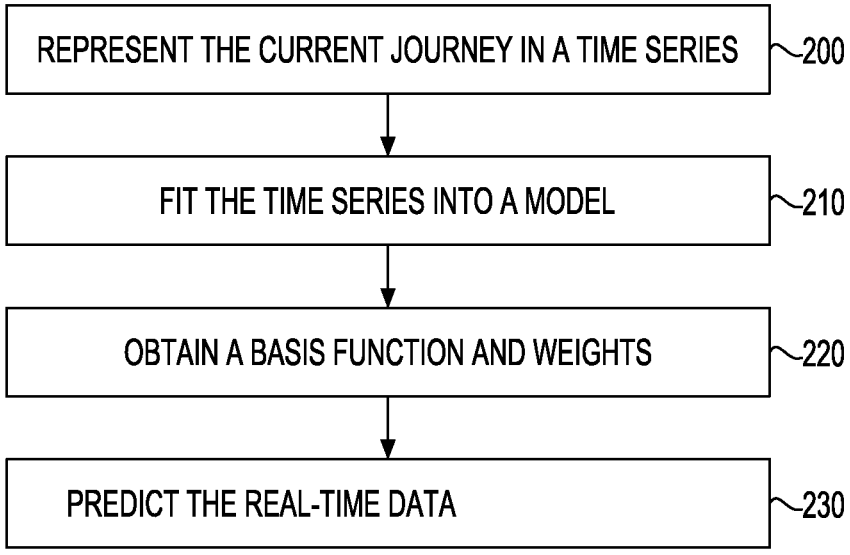
FIG. 2 is a flow chart illustrating method steps operated by a GPS simulator according to one embodiment.

In one embodiment, if the GPS device 310 is not available to send the real-time GPS data of bus locations to the computing system 400 for a certain period time or according to a pre-determined schedule, the GPS simulator 315 emulates the real-time GPS data, for example, as described in FIG. 2, and then sends the emulated real-time GPS data to the computing system 400.

In one embodiment, the computing system 400 receives the emulated real-time GPS data of bus locations as input and estimates a bus arrival time at a next bus stop, e.g., as shown in FIG. 9. In this embodiment, the computing system receives the reference time point 900 (e.g., 9:00 AM) at "stop 2" as indicated in FIG. 9 from the GPS simulator 315. In a further embodiment, the computing system may also receive the future traffic condition information from the TPT 320 and reflects the future traffic condition information to estimate the bus arrival time, e.g., by solving formulas (7)-(8) as described below. In this embodiment, the computing system 400 receives the emulated GPS data and the future traffic condition information as inputs to estimate a bus arrival time, e.g., by computing formulas (7) and (8) that include terms which reflect the emulated/real-time GPS data and future traffic condition information.

Figure 10:
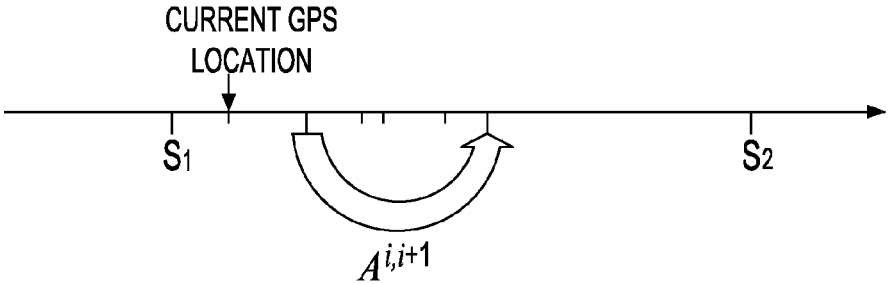
FIG. 10 illustrates a model that uses future traffic condition information from TPT to predict a deviation of an average bus travel time on an exemplary bus route in one embodiment.

FIG. 10 illustrates formulas 1030-1040 that calculate a predicted bus travel time between two points (bus stops) along a bus route based on the prior travel times, distances between bus stops and the future traffic condition information from the TPT 320. $A_t^{i,i+1}$ 1000 refers to herein a travel time between a bus stop i and another bus stop i+1. $\mu A_t^{i,i+1}$ 1010 refers to herein an expected travel time based on time series of the deviation from the regular trend. $\partial A_t^{i,i+1}$ 1020 refers to herein the regular trend, e.g., a benchmark of prior travel times in past with similar date and time characteristic. $V_{t+k}^{i+1}$ 1050 refers to herein future traffic speed or quantity on a bus route segment "t+k" between the bus stop i and another bus stop i+1. The computing system 400 receives this future traffic speed or quantity from the TPT 320. $\mu V_{t+k}^{i+1}$ refers to herein a historical average of traffic quantity or speed on the segment "t+k." $\lambda_k$ represents a smoothing parameter. The computing system 400 calculates the predicted bus travel time, e.g., by solving formulas 1030-1040.

Figures 5, 6:
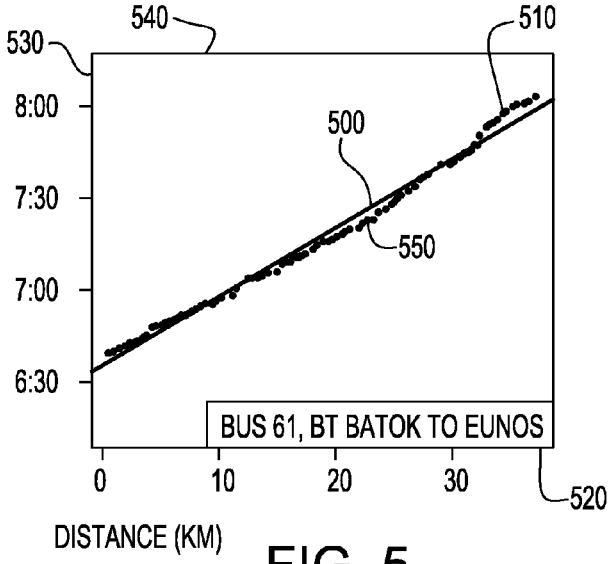
FIG. 5 is a graph illustrating a slope representing a bus speed and residuals representing deviations in one embodiment.
FIG. 6 illustrates exemplary experiment results of the present invention in one embodiment.

FIG. 6 illustrates forecast error (minutes) over multiple bus trips of exemplary bus numbers 61 (upper table 620) and 75 (lower table 630) during a certain time period (breakdown by bus stops). Each stop (e.g., bus stop 640) is indexed by its distance from a departure and its corresponding entry is included in the tables 620-630. M1 (e.g., M1 600) shows entries representing errors of the estimated bus arrival time based on a forecasting model (i.e., bus arrival time 920=reference time point 900+estimated bus travel time 910 as shown in FIG. 9). Note that the forecasting model may not utilize the future traffic condition information from the TPT 320. M2 (e.g., M2 620) shows entries representing errors of a model (e.g., formulas 1030-1040 in FIG. 10) with additional variables of the future traffic condition on relevant segments (bus route segments). For example, a data entry 640 represents that a bus arrives 0.981 minutes later or earlier than the bus arrival time predicted by the formulas 1030-1040. A data entry 650 represents that a bus arrives 1.558 minutes later or earlier than the bus arrival time estimated by the forecasting model described in FIG. 9. Exemplary two choices of forecasting horizon, e.g., 10 stops ahead and 5 stops ahead, have been presented in the tables 620-630.

In one embodiment, from prior bus travel times and/or historical bus arrival times, the computing system 400 finds when a bus used to arrive at a certain bus stop. The database 340 may additionally store distance information that indicates how far bus stops are from each other. Based on the prior bus travel times, historical bus arrival times and/or the distance information between bus stops, the computing system 400 analyzes the relationship between bus travel times and the distance information. Graphs 800-810 in FIG. 8 show a linear relationship (e.g., a slope 890) between bus travel times and travel distances. This linear relationship represents that, for each bus, its overall journey follows a relatively constant travel speed. This relatively constant travel speed (e.g., slope 890) represents a regular trend of the bus travel times and travel distances.

However, even though a bus has a stable travel behavior within a journey, an overall average speed between different journeys may differ due to different traffic conditions, e.g., driver's behavior, etc. The graph 720 in FIG. 7 illustrates this deviation. The graph 720 plots multiple journeys on a same bus route. A Y-axis 770 in the graph 720 represents shifted bus stop arrival times (the starting time is set to 0), and an X-axis 765 represents a distance from a departure. Different dots represent different journeys. The linear slope 710 represents the regular trend (e.g., average travel speed), and dots 760 above and underneath the slope 710 represents the deviations from the regular trend.

In one embodiment, the computing system 400 fits each journey to a linear model (e.g., the linear slope 710), $$T=S*D+I+R,$$

where T represents an estimated bus travel time, S represents the fitted slope (e.g., the slope 710), D represents a travel distance, I represents a fitted interception term (e.g., a constant term), R represents a fitted deviation. The computing performs this fitting, e.g., by using a linear regression technique. Graphs 1100-1110 in FIG. 11 plot slopes of a plurality of prior journeys ordered by a journey starting time. The graphs 1100-1110 show seasonal pattern (trend) on weekday (e.g., weekdays 1140 and 1170) and weekend (e.g., weekends 1150 and 1160). Deviations from a linear model also show certain spatial characteristics. For example, the graph 715 in FIG. 7 shows the deviations (e.g., deviations from a historical average speed) of two journeys with similar starting time from three consecutive days. Deviation curves 750-755, which represent the deviations, shows similarity (e.g., similar curves) between the deviation curves which may correspond to characteristics of bus stops, e.g., urban area vs. rural area. Such similarity allows the computing system 400 to build an estimator (e.g., deviation curves 750-755) of deviations that may be used to refine the linear model, e.g., by constructing a formula described herein as a formula (0) that includes terms reflecting the regular trend and the deviations.

In one embodiment, prior bus travel times may reflect journeys with different trends. Thus, in this embodiment, the computing system 400 divides the prior bus travel times into different data set. For example, the computing system 400 divides the prior bus travel times according to a day of a week (e.g., Monday, Tuesday-Thursday, Friday, Saturday-Sunday) and/or a time of a day (e.g., 6 AM, 6:15 AM, 6:30 AM . . . , 12 PM, 12:15 PM, etc.). In the time of a day case, a start time of a journey belongs, for example, between (journey start time−7.5 minutes) and (journey start time+7.5 minutes). Thus, the computing system 400 may use same time period and same case (e.g., a time of a day case) data to estimate a current journey. Since prior journeys with a particular time period and a particular case characteristic have a similar trend and deviation with the current journey that also occurs at the particular time period and with the particular case characteristic, the computing system 400 computes the regular trend and deviation from the regular trend for the current journey as follows:

$$S_{predict}=w_1S_1+w_2S_2+\ldots+w_nS_n$$

$$R_{predict}=w_1R_1+w_2R_2+\ldots+w_nR_n,$$

where $S_{predict}$ represents an estimated slope for the current journey, $R_{predict}$ represents an estimated deviation for the current journey, $S_1$, $S_2$ . . . $S_n$ represents slopes for prior journeys, $R_1$, $R_2$ . . . $R_n$ represents prior deviations for prior journeys, $w_1$, $w_2$ . . . $w_n$ represents weights for the prior journeys' slopes and deviations, and n represents the number of prior journeys. The weights give different value to different prior journeys. In one embodiment, the computing system 400 give larger weights to prior journeys whose travel dates are closer to the current journey and give smaller weights to prior journey whose travel dates are further away from the time of the current journey.

In one embodiment, the computing system 400 can use the latest real-time GPS data of bus locations and the calculated parameters (e.g., $S_{predict}$, $R_{predict}$, etc.) of the current journey to estimate bus arrival times at upcoming bus stops. For example, the computing system solves the following equation to estimate a bus arrival time at a bus stop:

$A_p=A_r+T_{rp}$, where $A_p$ represents an estimated bus arrival time (e.g., the estimated bus arrival time 920 in FIG. 9), $A_r$ represents a bus arrival time at a reference time point (e.g., a reference time point 900 in FIG. 9) according to the latest real-time GPS data, and $T_{rp}$ represents an estimated travel time (e.g., the estimated bus travel time 910 in FIG. 9) from a bus location of the referent time point to a subsequent bus stop, e.g., calculated by averaging prior travel times between the referent time point location and the subsequent bus location.

In a further embodiment, the computing system 400 expands the previous equation (i.e., $A_p=A_r+T_{rp}$) as follows:

$$A_p=A_r+S_{predict}*D_{rp}+R^p_{predict}-R^r_{predict} \quad (0),$$

where $S_{predict}$ represents an estimated slope for the current journey as described above, $R^p_{predict}$ represents an estimated deviation for the current journey at a subsequent bus stop and is equivalent to $R_{predict}$ above. $R^r_{predict}$ represents a deviation for the current trip at reference time point location and is calculated similarly to $R_{predict}$ above. $D_{rp}$ represents a distance from reference time point location to the subsequent bus stop. The computing system 400 calculates $D_{rp}$ based on the latest real-time GPS data of the reference time point and map data of the corresponding bus route. Specifically, the computing system 400 calculates the distance $D_{rp}$, e.g., by matching the reference time point location to a location on the map data. $D_{rp}$ may not be a straight line distance between the reference time point location and the location on the map data. Instead, $D_{rp}$ may be a distance along the bus route.

FIG. 5 illustrates an exemplary graph 540 that includes a linear model (e.g., a straight line 500) and deviations (e.g., a deviation 510). In the graph 540, points (e.g., dots 510 and 550) represent actual bus arrival times. The straight line 500 represent is a linear trend. X-axis 520 represents a distance from a departure. Y-axis 530 represents bus arrival times at bus stops. However, as shown in the graph 540, the linear trend is not fully accurate (e.g., there are deviations 510 and 500) to reflect actual bus arrival times. Thus, by adding estimated deviations (e.g., estimated deviations 700-755 in FIG. 7) to the linear trend, the computing system estimates bus arrival times that are closer (i.e., more accurate) to actual bus arrival times. When a bus arrives at a reference time point location (e.g., stop 2 in FIG. 9), the computing system use this reference time point (e.g., the reference time point 9:00 AM 900 in FIG. 9) as a reference time to estimate a bus arrival time to other remaining stops. Since the reference time may have its own deviation(s), therefore it needs to be adjusted by subtracting its own deviations. For example, the computing system may select reference time points, e.g., every 5 bus stops or every 10 bus stops that approximately correspond to 5-8 minutes and 15-20 minutes to a target bus stop (i.e., bus stop where a bus arrival time is estimated).

In one embodiment, the GPS simulator 315 operates based on patterns or trends, e.g., graphs 800-810 in FIGS. 8A-8B that plot bus stop arrival times v. distances from departures. Each bus journey can be fitted to, for example, a smooth curve model. Such smooth curve model has a resemblance among journeys with similar starting times of a day. Alternatively, each journey can be fitted to a linear model as guided in the graphs 800-810 in FIGS. 8A-8B. FIG. 2 illustrates method steps performed by the GPS simulator 315 for estimating the smooth curve in one embodiment.

Let x(t) be a distance of a bus location from its departure at time point t. Reporting time points are represented by a set of integers: 1, 2, 3, etc. At step 200 in FIG. 2, the computing GPS simulator 315 represents the current journey in a time series $\{x_i(t): t=1, 2, \ldots, m\}$, where i is a journey index in a day of a same bus service number and direction, and m is the number of time points observed in a prior complete journey. The journeys with similar starting times and similar days show similar trends and therefore constitute an ensemble of a smooth curve. At step 210, the GPS simulator 315 fits the time series to a smooth curve model, e.g., by using smoothing spline method. Smoothing spline method refers to herein a method of smoothing (fitting a smooth curve to a set of samples) by using a piecewise polynomial function. Brian Alford, et al., "An Analysis of Various Spline Smoothing Techniques for Online Auctions AMSC 689," December 2004, wholly incorporated by reference, describes various smoothing spline methods in detail.

Denote by $f_k(t)$ the $k_{th}$ smooth curve factor. At step 220, the GPS simulator 315 obtains a basis function and weights (see formula (1) below) from the fitted smoothing curve model:

$$x_i(t)=\beta_{i1}f_1(t)+\ldots+\beta_{ik}f_k(t)+\partial_i(t) \quad (1),$$

where $\partial_i(t)$ is a random error, $\beta_{i1}, \ldots, \beta_{ik}$ are the weights for the curve factor. K is the number of smooth curve factors. The value of K is smaller than m, which is the number of time points observed in a prior complete journey. This model (i.e., formula (1)) can be fitted, for example, sequentially to the time series. More specifically, the first smooth curve factor is obtained by a penalized least square fitting:

$$\min_{\beta_1,\ldots,\beta_n,f} \sum_{i=1}^{n}\sum_{j=1}^{m}[X_{ij}-\beta_i f_i(t_j)]^2+\lambda\left(\sum_{i=1}^{n}\beta_i^2\right)\int[f_i''(t)]^2 dt, \quad (2)$$

where n is the number of prior journeys with similar starting times, λ is a smoothing parameter, and i and j are indices for summations. $X_{ij}$ represents an element of a matrix X whose elements include $x_i(t)$ described in formula (1). The second term in formula (2) represents a penalty for roughness of the fitted smoothing curve. Subsequent smooth curve factors $f_i(t)$ and their corresponding weights $\beta_i$ can be obtained, e.g., by fitting equations similar to formula (2) successively to data representing deviations, e.g., a matrix whose elements are in $X_{ij}-\beta_i f(t_j)$. A solution to the formula (2) has an analytical form. More specifically, let $\beta=(\beta_{i1}, \ldots, \beta_{ik})^T$, $X=(X_{ij})\epsilon R^{n\times m}$, and $f=(f_1, \ldots, f_n)^T$ where $f_j:=f(t_j)$, a solution denoted by $\hat{f}(.)$ of the formula (2) is a natural cubic spline (i.e., a spline constructed with piecewise polynomials which pass through a set of data points; a spline refers to a mathematical function used for smoothing) with data points at $\{t_j: j=1, \ldots, m\}$ and its value at these data points are obtained by solving the following optimization problem:

$$\min_{\beta, f}\{\|X-\beta f^T\|_F^2+\lambda\beta^T\beta f^T\Omega f\} \tag{3}$$

where $\|\ \|_F$ is the Frobenius norm of a matrix, and $\Omega=QR^{-1}Q^T$. Auxiliary matrices Q and R are defined as follows:

$$Q=(q_{jk})\in R^{m\times m-2},$$

$$q_{kj}=\begin{cases}\frac{1}{h_k}, & |j-k|=1;\\ -\frac{1}{h_{k-1}}-\frac{1}{h_k}, & j=k;\\ 0, & |j-k|>=2.\end{cases},$$

where $m\times m-2$ represents $m\times(m-2)$.

$$R\in R^{(m-2)\times(m-2)}=(R_{kj}),$$

$$R_{kj}=\begin{cases}\frac{1}{6}h_{j\vee k}, & |j-k|=1;\\ \frac{1}{3}(h_{j-1}+h_j), & j=k(=2,\ldots,m-1);\\ 0, & |j-k|>=2.\end{cases}$$

where k and j are generic indices ranging from 1 to m−1 where m was defined above, h is a symbol for a bus interval width, Ω is a symbol for a matrix and it is further defined through Q and R by the relationship $\Omega=QR^{-1}Q^T$, and jvk represents a maximum value of j and k.

For a given weight β, the GPS simulator 315 acquires the solution to the formula (3), e.g., by computing $\hat{f}=(I+\lambda\Omega)^{-1}Y^T\beta$. On the other hand, for a given f, the GPS simulator 315 acquires the solution to the formula (3), e.g., by computing $$\beta=\frac{Xf}{f^T(I+\lambda\Omega)f},$$

where f represents a smooth curve factor, I represents an identity matrix, and $f^T$ represents a transpose of f. These solutions lead to the following iterative approach to solve the formula (3).

1: Initialize f in the s=0 step.

2: In the s>0 th iteration, do the following:

$$\beta^s\leftarrow Xf^{s-1},$$

$$f^s\leftarrow(I+\lambda\Omega)^{-1}X^T\beta^s,\ f^s\leftarrow f^s\Big/\sum_{j=1}^{m}f_j^s,$$

3: Terminate iteration if $\|f^s-f^{s-1}\|^2+\|\beta^s-\beta^{s-1}\|^2$<predefined threshold, otherwise set s←s+1 and return to step 2.

s refers to herein an index. The choice of smoothing parameter λ can be made, e.g., by a cross-validation technique. Cross-validation technique refers to a technique to assess how results of statistical analysis generalize an independent data set.

In one embodiment, the GPS simulator 315 groups prior journeys with similar starting times and fit the grouped prior journeys to the smooth curve to obtain the basis function of $f_k(t)$ for k=1, . . . , K and the respective weights $\hat{\beta}_1,\ldots,\hat{\beta}_K$. The same basis function and weights can be applied to future journeys which share similar starting time characteristics:

$$\hat{x}(t)=\hat{\beta}_1f_1(t)+\ldots+\hat{\beta}_Kf_K(t) \tag{4}$$

Returning to FIG. 2, at step 230, the GPS simulator 315 predicts or emulates the real-time GPS data of bus locations, e.g., by computing formula (4). $\hat{x}(t)$ in the formula (4) represents an estimated distance of a current bus location from its origin or departure at time point t.

In one embodiment, the GPS simulator 315 predicts the smoothing curve, for example, according to two different scenarios. First, the curve to be predicted may have no observed data at all (e.g., the bus journey has not even started yet). The GPS 315 handles this scenario, e.g., by solving formula (4) with proper choice of training data for an estimation of the weights and basis function. Another scenario is that the GPS simulator 315 has observed data from an initial segment of the smoothing curve to be predicted. For example, in the middle of the current journey, the GPS simulator 315 may want to predict the curve that corresponding to the remaining route of the current journey. In one embodiment, the GPS simulator 315 integrates information already collected from the initial segment of the curve, e.g., by computing formula (5) below. In one embodiment, the computing system updates the fitted smoothing curve in real-time upon receiving additional data (e.g., new data representing additional prior travel times, etc.).

Assume that the GPS simulator 315 selects n prior journeys (with similar starting time characteristics) and obtains their "K" number of basis functions $f_k(t)$ and weights $\hat{\beta}_k$. The GPS simulator 315 also receives current journey's initial segment $\{x_{n+1}(t_0), x_{n+1}(t_1), \ldots, x_{n+1}(t_{\tilde{m}})\}$ where $\tilde{m}$<m and $t_0<t_1<\ldots,t_{\tilde{m}}$, from the GPS device 310. Thus, if the GPS device 310 becomes unavailable after sending partial real-time GPS data (e.g., bus location information in the current journey's initial segment) to the computing system 400, the GPS simulator 315 updates the weights of the basis functions based on the partial real-time GPS data. In other words, the GPS simulator 315 fits the same basis functions with slightly adjusted weights to a smoothing curve from which the partial real-time GPS data is observed. In this scenario, the GPS 315 solves a similar objective function according to a penalized least square fitting as follows:

$$\min_{\beta_{n+1,1},\ldots,\beta_{n+1,K}}\sum_{j=0}^{\tilde{m}}\left[x_{n+1}(t_j)-\sum_{k=1}^{K}\beta_{n+1,k}f_k(t_j)\right]^2+\lambda\sum_{k=1}^{K}(\beta_{n+1,k}-\hat{\beta}_k)^2, \tag{5}$$

where λ is a smoothing parameter. The second term in the formula (5) functions as a regularizer which ensures that a new β stay close to the prior weights. In one embodiment, when solving the formula (5), the computing system 400 assumes that the basis functions $f_k(t)$ have been estimated and their values at data points $t_j$ are known.

Having obtained the updated weights adjusted to the real-time GPS data up to time point $t_{\tilde{m}}$ in the current journey, the GPS simulator 315 may apply the formula (4) (substitute with the updated weights) to predict a distance from a departure at subsequent time points after $t_{\tilde{m}}$. The graph 1200 in FIG. 12 illustrates the GPS simulator 315 predicts current locations 1240 of a bus at subsequent bus stops based on a smoothing curve 1230 that the GPS simulator 315 computes according to the method steps 200-230 in FIG. 2. In one embodiment, since the bus travels further and further away from its departure, therefore $x_{n+1}(t_j)$ is a non-decreasing function of $t_j$. In order to consider this constraint (i.e., $x_{n+1}(t_j)$ is a non-decreasing function of $t_j$), additional constraint on f: $f(t_1)<$ $t(t_2) < \ldots < f(t_m)$ may be imposed in the model fitting process, i.e., method steps 200-230 in FIG. 2. The basis functions obtained in formula (3) satisfies these constraints.

The GPS simulator 315 allows the computing system 400 to predict bus arrival times without using the GPS device 310. The GPS simulator 315 obtains a smoothing curve that predicts remaining segments of the current journey after the reference time point $t_{\tilde{m}}$, for example, $\hat{x}(t)=\hat{\beta}_1 f_1(t)+\ldots+\hat{\beta}_K f_K$; (t) where $t_{\tilde{m}}<t<m$. A distance from a departure to a current bus location is $x(t_{\tilde{m}})$. For any subsequence bus stop with distance $x_s>x(t_{\tilde{m}})$, the computing system 400 predicts a bus arrival time based on the predicted distance, the updated weights and the basis functions, e.g., by the solving the following optimization problem:

$$\min_t \left|\hat{\beta}_1 f_1(t)+\ldots+\hat{\beta}_K f_K(t)-x_s\right|<\delta, \tag{6}$$

where $\delta>0$ is a constant associated with a bus arrival at a bus stop. Since all the basis functions are continuous and monotone, the computing system 400 solves the formula (6), e.g., by using a binary search algorithm or other equivalent search algorithm. Wim Feijen, et al., "The Binary Search Revisited," AvG127/WF214, 1995, http://www.mathmeth.com/wf/files/wf2xx/wf214.pdf, whose contents are wholly incorporated by reference as if set forth herein, describes the binary search algorithm in detail.

Bus arrival times to subsequent bus stops from a current bus is closely related to future traffic conditions on the remaining segments of the current journey, and less related to past or current traffic conditions. Traditional systems that cannot receive accurate prediction of future traffic conditions rely on travel records and traffic conditions up to a current time point. In one embodiment, the computing system 400 integrates output (future traffic condition information on the remaining segments) from the TPT 320 into a bus arrival prediction model (e.g., formula (7) below).

In one embodiment, the computing system 400 computes a time duration between a bus arrival time to a current bus stop (index by c) and the one to be predicted (index by c+h; "h-stop" ahead bus arrival time), e.g., by solving the formula (7). Denote this time duration by $A^{c,c+h}$. Assume that $\mu A^{c,c+h}$ is a predicted duration from other models (e.g., formula (6), etc.) based on prior travel times and traffic information up to the current time point. The formula (7) presents a framework which integrates future traffic conditions on the remaining segments in a coherent way with the other models (e.g., the forecasting model in FIG. 9):

$$\log(A^{c,c+h})=\log(\mu A^{c,c+h})+\sum_{k=1}^{NO.ofTPTlinks}\alpha_k[\log(V_k^{c,c+h})-\log(\mu V_k^{c,c+h})], \tag{7}$$

where $V_k^{c,c+h}$ is a predicted traffic quantity on a segment (index by k) between the stops c,c+h, and $\mu V_k^{c,c+h}$ is a historical average of traffic quantity. The summation of the second term is over all segments (where traffic predictions are available) between the stop c,c+h and all relevant time intervals. More specifically, by assuming the current time is $t_{\tilde{m}}$, the maximum value of $A^{c,c+h}$ is $A_M^{c,c+h}$. The computing system 400 may include time interval(s) between $t_{\tilde{m}}$ and $t_{\tilde{m}}+A_M^{c,c+h}$.

The formula (7) includes several properties. First, it adds an improvement over other prediction models (e.g., $\mu A^{c,c+h}$), e.g., by considering future traffic conditions. The logarithm transformation in the formula (7) translates an adjustment to $\mu A^{c,c+h}$, e.g., by relative percentage. Second, the formula (7) adapts to varying length of each bus route segment. In other words, an impact on this duration time is varying to each bus route segment. Specifically, $\alpha_k$ in the formula (7) represents a weight of each (different) segment that reflects this varying length of each route. Third, the formula (7) differs fundamentally from traditional bus arrival prediction model: Rather than focusing on travel times on individual segments, the formula (7) reflects a deviation from the estimated arrival time over a whole bus route, and correlates the deviation from the estimated arrival time with a deviation from the future traffic status (e.g., the future traffic condition information) on a subset of the whole bus route where the traffic prediction tool (TPT) is installed. Due to correlations among different bus route segments, the deviation from the future traffic status on a subset of segments in a bus route can reflect that over the other subset of segments in the same route. Therefore the second term in the formula (7) integrates the impact of deviations from the regular trend in a collective manner. $V_k^{c,c+h}$ in the formula (7) can be traffic volume and/or road occupancy as well as traffic speed.

In a further embodiment, the formula (7) can reflect relevant passenger/bus behaviours, e.g., passenger activities at certain bus stops during a certain time of a day, spatial characteristics of a bus travel speed, etc, by reflecting these behaviours in the term $\mu A^{c,c+h}$. Multiple prediction models (e.g., $\mu A_b^{c,c+h}$) can also be included in an additive manner, for example:

$$\log(A^{c,c+h})=\sum_{b=1}^{B}\gamma_b\log(\mu A_b^{c,c+h})+\sum_{k=1}^{NO.ofTPTlinks}\alpha_k[\log(V_k^{c,c+h})-\log(\mu V_k^{c,c+h})], \tag{8}$$

where $\mu A_b^{c,c+h}$ represents a predicted bus travel time by other models (e.g., formula (0), etc.) between a bus stop c and a target bus stop c+h.

In one embodiment, the computing system 400 combines various bus arrival time prediction models (e.g., a model described in FIG. 9, formula (0), formula (7), formula (8), etc.), e.g., by using a linear combination. In other words, the computing system 400 combines bus arrival times predicted or estimated by diverse models to reduce a prediction error. A linear combination of variables refers to herein a method of making a new variable by using other variables. For example, W=10X+3Y+7Z, where W is a linear combination of variables, X, Y, and Z. Assume that there are B number of candidate models and errors in their past n predictions of $A^{c,c+h}$ (i.e., time duration between a bus arrival time to a bus stop c and a bus arrival time to a bus stop c+h) is denoted by $\{e_{i,b}$: b=1, . . . , B; i=1, . . . , n$\}$. A combined prediction is, for example, a linear combination of predictions from B candidate models $$\sum_{b=1}^{B} l_b A_b^{c,c+k}$$

subject to constraint $$\sum_{b=1}^{B} l_b = 1.$$

Let $\Sigma$ be a covariance matrix of the vector $e=(e_{\cdot,1}, \ldots, e_{\cdot,B})^T$ from a sample of n observations. An optimal choice of linear coefficients $\{l_b: b=1, \ldots, B\}$ can be obtained by solving the following optimization problem:

$$\min_{l=(l_1,\ldots,l_B)} l^T \Sigma l \text{ s.t. } \sum_{b=1}^{B} l_b = 1, \tag{9}$$

which finds a minimum value of (a transpose of $l \times \Sigma \times l$).

The computing system 400 may obtain the solution of formula (9), e.g., by using Lagrange multiplier. Lagrange multiplier finds a maximum and minimum of a function according to a constraint $$\left(\text{e.g., } \sum_{b=1}^{B} l_b = 1\right).$$

Karl Hahn, "Lagrange Multiplier Method for finding Optimums," 2008, http://www.karlscalculus.org/pdf/lagrange.pdf, whose contents and disclosure are wholly incorporated by reference as if fully set forth herein, describes Lagrange multiplier in detail.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with a system, apparatus, or device running an instruction.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with a system, apparatus, or device running an instruction.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may run entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which run via the processor of the computer or other programmable data processing apparatus, create means for implementing the functions/acts specified in the flowchart and/or block diagram block or blocks. These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which run on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more operable instructions for implementing the specified logical function(s). It should also be noted that, in some alternative implementations, the functions noted in the block may occur out of the order noted in the figures. For example, two blocks shown in succession may, in fact, be run substantially concurrently, or the blocks may sometimes be run in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

What is claimed is:

1. A method for determining a vehicle arrival time at a stop location along a vehicle route having multiple stop locations, the method comprising:

receiving information representing prior travel times of vehicles between vehicle stops along a vehicle route, each of said prior travel times occurring on a different travel date;

receiving real-time data representing a current journey, the current journey referring to a movement of a vehicle currently traveling along the route and the current journey comprising one or more subsequent vehicle stops of varying lengths, the current journey having a current date;

weighting the received information for each prior travel time based on a function of the travel time from a prior travel date and the current date to obtain a weight of prior travel time;

calculating a regular trend representing the current journey based on the received prior travel times information and the received real-time data, said calculating performed by summing, for each of the prior travel times, a product of the weight of the prior travel time and a slope representing an average vehicle travel speed for the corresponding prior travel time;

computing a deviation from the regular trend in the current journey, said computing performed by summing, for the prior travel times, a product of the weight of the prior travel time and a deviation of the corresponding prior travel time;

determining a future traffic status in the one or more subsequent vehicle stops in the current journey; and estimating, for the vehicle, each arrival time at each subsequent vehicle stop weighted based on the varying length and further based on the calculated regular trend, the computed deviation and the determined future traffic status, and determining a whole estimated arrival time in the current journey based on the estimated arrival times at each subsequent vehicle stop;

computing a deviation from the whole estimated arrival time in the current journey;

computing a deviation from the determined future traffic status in the current journey;

correlating the deviation from the whole estimated arrival time with the deviation from the future traffic status;

updating the whole estimated arrival time based on the deviation from the whole estimated arrival time, the deviation from the future traffic status, and the correlation, wherein at least one processor in a computing system performs one or more of: the receiving, the calculating, the computing the deviation from the regular trend, the determining, the estimating, the computing the deviation from the estimated arrival time, the computing the deviation from the future traffic status, the correlating, and the updating.

2. The method according to claim 1, wherein the calculating the regular trend comprises:

performing a trend analysis or clustering on the received prior travel times information and the received real-time data.

3. The method according to claim 1, wherein the computing the deviation comprises:

performing a regression analysis on the received prior travel times information and the received real-time data.

4. The method according to claim 1, wherein the determining the future traffic status comprises:

obtaining future traffic condition information of the subsequent vehicle stops from a traffic prediction tool, the future traffic condition information of the subsequent vehicle stops being integrated in the estimated arrival time.

5. The method according to claim 1, wherein the receiving the real-time data includes: using a GPS (Global Positioning System) device.

6. The method according to claim 5, wherein if the GPS device is not available to send the real-time data to the computing system for a certain period of time, a GPS simulator emulates the real-time data and sends the emulated real-time data to the computing system.

7. The method according to claim 6, wherein the GPS simulator performs steps of:

representing the current journey in a time series;

fitting the time series into a model;

obtaining, from the model, a basis function and weights associated with the basis function; and predicting the real-time data based on the basis function and the weights.

8. The method according to claim 7, wherein the model is a smooth curve model or a linear model.

9. The method according to claim 7, wherein if the GPS device becomes unavailable after sending partial real-time data to the computing system, the GPS simulator further performs: updating the weights of the basis function based on the partial real-time data from the GPS device.

10. The method according to claim 9, wherein the GPS simulator further performs: predicting, based on the updated weights and the basis function, a distance from a departure at the subsequent time points after a last time point when the GPS device sent the partial real-time data.

11. The method according to claim 10, further comprising:

predicting a vehicle arrival time at each subsequent stop based on the predicted distance, the updated weight, and the basis function.

12. The method according to claim 11, wherein the predicting the vehicle arrival time uses a binary search algorithm.

13. The method according to claim 12, further comprising:

combining the estimated arrival time and the predicted arrival time using a linear combination.

14. A system for determining a vehicle arrival time at a stop location along a vehicle route having multiple stop locations, the system comprising:

a memory device; and a processor being connected to the memory device, wherein the processor performs steps of:

receiving information representing prior travel times of vehicles between vehicle stops along a vehicle route, each of said prior travel times occurring on a different travel date;

receiving real-time data representing a current journey, the current journey referring to a movement of a vehicle currently traveling along the route and the current journey comprising one or more subsequent vehicle stops of varying lengths, the current journey having a current date;

weighting the received information for each prior travel time based on a function of the travel time from a prior travel date and the current date to obtain a weight of prior travel time;

calculating a regular trend representing the current journey based on the received prior travel times information and the received real-time data, said calculating performed by summing, for each of the prior travel times, a product of the weight of the prior travel time and a slope representing an average vehicle travel speed for the corresponding prior travel time;

computing a deviation from the regular trend in the current journey, said computing performed by summing, for the prior travel times, a product of the weight of the prior travel time and a deviation of the corresponding prior travel time;

determining a future traffic status in the one or more subsequent vehicle stops in the current journey; and estimating, for the vehicle, each arrival time at each subsequent vehicle stop weighted based on the varying length and further based on the calculated regular trend, the computed deviation and the determined future traffic status, and determining a whole estimated arrival time in the current journey based on the estimated arrival times at each subsequent vehicle stop;

computing a deviation from the whole estimated arrival time in the current journey;

computing a deviation from the determined future traffic status in the current journey;

correlating the deviation from the whole estimated arrival time with the deviation from the future traffic status;

updating the whole estimated arrival time based on the deviation from the whole estimated arrival time, the deviation from the future traffic status, and the correlation.

15. The system according to claim 14, wherein to calculate the regular trend, the processor performs a trend analysis or clustering on the received prior travel times information and the received real-time data.

16. The system according to claim 14, wherein to compute the deviation, the processor performs a regression analysis on the received prior travel times information and the received real-time data.

17. The system according to claim 14, further comprising:

a traffic prediction tool for obtaining future traffic condition information of the subsequent vehicle stops, wherein the processor integrates the future traffic condition information of the subsequent vehicle stops into the estimated arrival time.

18. The system according to claim 14, wherein the processor receives the real-time data from GPS device or GPS simulator.

19. The system according to claim 18, wherein the GPS simulator performs steps of:

representing the current journey in a time series; fitting the time series into a model; obtaining, from the model, a basis function and weights associated with the basis function; and predicting the real-time data based on the basis function and the weights.

20. The system according to claim 19, wherein if the GPS device becomes unavailable after sending partial real-time data to the computing system, the GPS simulator updates the weights of the basis function based on the partial real-time data from the GPS device.

21. The system according to claim 20, wherein the GPS simulator further performs:

predicting, based on the updated weights and the basis function, a distance from a departure at the subsequent time points after a last time point when the GPS device sent the partial real-time data.

22. A computer program product for determining a vehicle arrival time at a stop location along a vehicle route having multiple stop locations, the computer program product comprising a storage medium readable by a processing circuit and storing instructions run by the processing circuit for performing a method, the method comprising:

receiving information representing prior travel times of vehicles between vehicle stops along a vehicle route, each of said prior travel times occurring on a different travel date;

receiving real-time data representing a current journey, the current journey referring to a movement of a vehicle currently traveling along the route and the current journey comprising one or more subsequent vehicle stops of varying lengths, the current journey having a current date;

weighting the received information for each prior travel time based on a function of the travel time from a prior travel date and the current date to obtain a weight of prior travel time;

calculating a regular trend representing the current journey based on the received prior travel times information and the received real-time data, said calculating performed by summing, for each of the prior travel times, a product of the weight of the prior travel time and a slope representing an average vehicle travel speed for the corresponding prior travel time;

computing a deviation from the regular trend in the current journey, said computing performed by summing, for the prior travel times, a product of the weight of the prior travel time and a deviation of the corresponding prior travel time;

determining a future traffic status in the one or more subsequent vehicle stops in the current journey; and estimating, for the vehicle, each arrival time at each subsequent vehicle stop weighted based on the varying length and further based on the calculated regular trend, the computed deviation and the determined future traffic status, and determining a whole estimated arrival time in the current journey based on the estimated arrival times at each subsequent vehicle stop;

computing a deviation from the estimated arrival time in the current journey;

computing a deviation from the determined future traffic status in the current journey;

correlating the deviation from the whole estimated arrival time with the deviation from the future traffic status;

updating the whole estimated arrival time based on the deviation from the whole estimated arrival time, the deviation from the future traffic status, and the correlation.

23. The computer program product according to claim 22, wherein the real-time data is provided from a GPS device or GPS simulator, the GPS simulator performs steps of:

representing the current journey in a time series;

fitting the time series into a model;

obtaining, from the model, a basis function and weights associated with the basis function; and predicting the real-time data based on the basis function and the weights.

24. The method according to claim 1, wherein a larger weight is given to prior journeys whose travel dates are closer to the current date, and a smaller weight is given to a prior journey whose travel dates are further away from the time of the current date.

25. The method according to claim 1, wherein said estimating, for the vehicle, an arrival time at a subsequent vehicle stop comprises calculating:

$$A_p = A_r + S_{predict} * D_{rp} + R^p_{predict} - R^r_{predict},$$

where $A_p$ represents an updated estimate arrival time, $A_r$ represents a bus arrival time at a reference vehicle stop, $D_{rp}$ represents a distance from the reference bus stop to the subsequent vehicle stop, $R^p_{predict}$ represents the computed deviation from the regular trend of the current journey, $R^r_{predict}$ represents a deviation for the current trip at a reference time point location, $S_{predict}$ represents an estimated slope for the current journey and is calculated by the summing the product the slopes for prior journeys and corresponding weights of the prior journey's slopes.

26. The method according to claim 1, wherein said updating the whole estimated arrival time based on the deviation from the whole estimated arrival time, the deviation from the future traffic status, and the correlation comprises calculating a time duration $A^{c,c+h}$ between a vehicle arrival time at a current bus stop c and a subsequent vehicle stop c+h defining a vehicle route segment according to:

$$\log(A^{c,c+h}) = \log(\mu A^{c,c+h}) + \sum_{k=1}^{NO.ofTPTlinks} \alpha_k [\log(V_k^{c,c+h}) - \log(\mu V_k^{c,c+h})]$$

where $\mu A^{c,c+h}$ is a predicted duration based on said prior travel times and vehicle traffic information up to a current time point;

$V_k^{c,c+h}$ is a predicted traffic quantity on a vehicle route segment k between the vehicle stops c and c+h;

$\mu V_k^{c,c+h}$ is a historical average of traffic quantity;

$\alpha_k$ represents a weight of the vehicle route segment; and

NO.ofTPTlinks represents a number of segments providing future traffic status information between the vehicle stops c and c+h.

* * * * *